US005211672A

United States Patent [19]

Andujar

[11] Patent Number: 5,211,672

[45] Date of Patent: May 18, 1993

[54] PROTECTIVE SHOE

[76] Inventor: Edward M. Andujar, 87 West Riverside Dr., Mays Landing, N.J. 08330

[21] Appl. No.: 777,907

[22] Filed: Oct. 17, 1991

Related U.S. Application Data

[63] Continuation of Ser. No. 506,061, Apr. 9, 1990, abandoned.

[51] Int. Cl.[5] ..... A43B 5/00; A43B 19/00

[52] U.S. Cl. ..... 36/106; 36/2 R; 36/114

[58] Field of Search ..... 36/113, 2 R, 114, 105, 36/106

[56] References Cited

U.S. PATENT DOCUMENTS

| | | | |
|---|---|---|---|
| 3,667,140 | 6/1972 | Hunderford | 36/4 |
| 3,769,722 | 11/1973 | Rhee | 36/2 R |
| 3,949,493 | 4/1976 | Rhee | 36/2 R |
| 4,008,531 | 2/1977 | Schonbron et al. | 36/106 |
| 4,051,613 | 10/1977 | Collins | 36/114 |
| 4,103,437 | 8/1978 | Dillard | 36/106 X |
| 4,190,971 | 3/1980 | Wren, Jr. et al. | 36/114 X |
| 4,361,912 | 12/1982 | Arthur | 36/114 X |
| 4,361,970 | 12/1982 | Wren, Jr. et al. | 36/114 X |
| 4,397,105 | 8/1983 | Richardson | 36/114 X |

FOREIGN PATENT DOCUMENTS

| | | | |
|---|---|---|---|
| 2847868 | 5/1980 | Fed. Rep. of Germany | 36/114 |
| 2595215 | 9/1987 | France | 36/114 |

*Primary Examiner*—Steven N. Meyers
*Assistant Examiner*—Bethanne C. Cicconi
*Attorney, Agent, or Firm*—John S. Hale; Gipple & Hale

[57] ABSTRACT

A protective shoe for use in contact sports of the martial arts comprising a unitary upper member constructed of a foam base defining an opening and side slits into which a foot can be inserted. An elastic strap provided with fasteners is secured to the upper member allowing the upper member to be attached around the ankle of the wearer. A sole is mounted to the bottom of the upper member to provide an enclosed toe area and an arch area with cutouts in the sole defining an open heel area and open ball of foot area. A protective instep pad and achilles tendon pad are secured to said upper member to give additional foot protection to the user.

10 Claims, 4 Drawing Sheets

PROTECTIVE SHOE

This is a continuation of application Ser. No. 07/506,061 filed Apr. 9, 1990, now abandoned.

BACKGROUND OF THE INVENTION

1. Field of the Invention

The invention generally relates to protective sports equipment and particularly to protective equipment used in the martial art sports, namely, a karate boot or shoe which is used in such sport.

2. Prior Art

Various types of protective shoes and coverings have been developed for use in the martial arts. One pertinent prior art reference, U.S. Pat. No. 4,361,912; discloses a karate shoe having a pair of throughgoing slits extending from the opening of the shoe downward to the wearer's ankle bone where each slit ends in a circular opening allowing the top section of the shoe to be easily spread apart for insertion of the wearer's foot. A VELCRO strap is adhesively secured to the ankle support area to hold the ankle support portions separated by the slits together. The bottom of the shoe is open or soleless with the exception of two fastened vinyl straps, one of which extends across the bottom of the shoe in the ball of the foot area and the other extending across the bottom of the shoe in the area of the arch.

Another patent of interest is U.S. Pat. No. 3,769,722; which discloses a soleless karate shoe constructed of a casing of a soft resilient material having an opening at the top for the insertion of the foot and provided with straps around the top of the upper and around the open body to hold the shoe on the foot.

U.S. Pat. No. 2,657,477 discloses a covering for protection of a foot with a toe portion ending at the sole of the foot.

In addition, other patents relating to the present inventive subject matter are U.S. Pat. Nos. 2,541,738; 2,814,887; 3,104,479; 4,361,970 and 4,495,715.

The above-noted references are provided as means for protecting the feet of combatants in karate or contacttype sports. However, the problem with these various prior art devices are that they do not provide sufficient protection at specific stress points and fracture areas of the foot and toes and therefore do not effectively prevent the occurrence of various injuries when being used. Furthermore, the shoes of the prior art patents because of their construction wear out or tear at contact and stress points. The aforementioned invention overcomes these problems with its unique construction and safety features by providing a protective right and left shoe adapted to significantly lessen the chance of injury to the foot and to the opponent.

SUMMARY OF THE INVENTION

The present invention is directed to a protective shoe for use in contact sports of the martial arts variety comprising a unitary sponge based upper member defining an opening and associated slits extending downward from the opening into which a foot can be inserted and an elastic strap secured to the upper member. VELCRO fasteners are attached to opposite sides of the strap allowing the upper member to be firmly held around the ankle of the wearer. A sole member comprising an enclosed toe portion and arch portion and defining an open heel area and open ball of foot area is secured to the bottom of the upper and an instep pad and achilles tendon pad are secured to the upper member.

One object of the present invention is to provide the shoes with specific extra shell or cushioned areas to protect the user from fracture or injury or injury to the opponent with toenails.

Another object is to provide the user with a ventilated toe shield to keep the toes from extending out of the shoe and being subjected to injury.

Another object is to provide the user with a contoured fit to the right and left foot.

In the accompanying drawings, there is shown an illustrative embodiment of the invention from which these and other of objectives, novel features and advantages will be readily apparent.

DETAILED DESCRIPTION OF THE DRAWINGS

Figure 1:
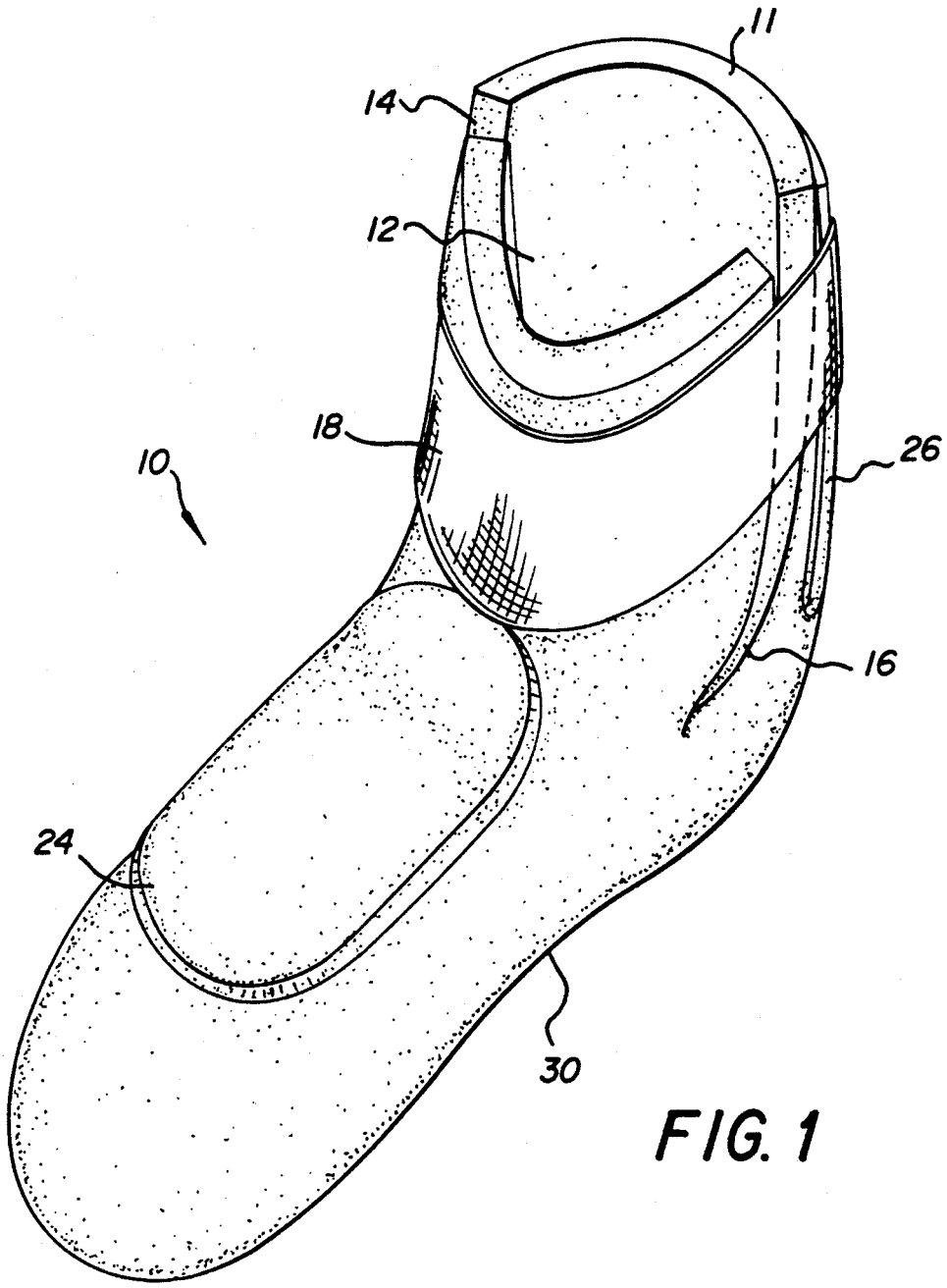
FIG. 1 is a perspective view of the shoe according to the invention.
Figure 2:
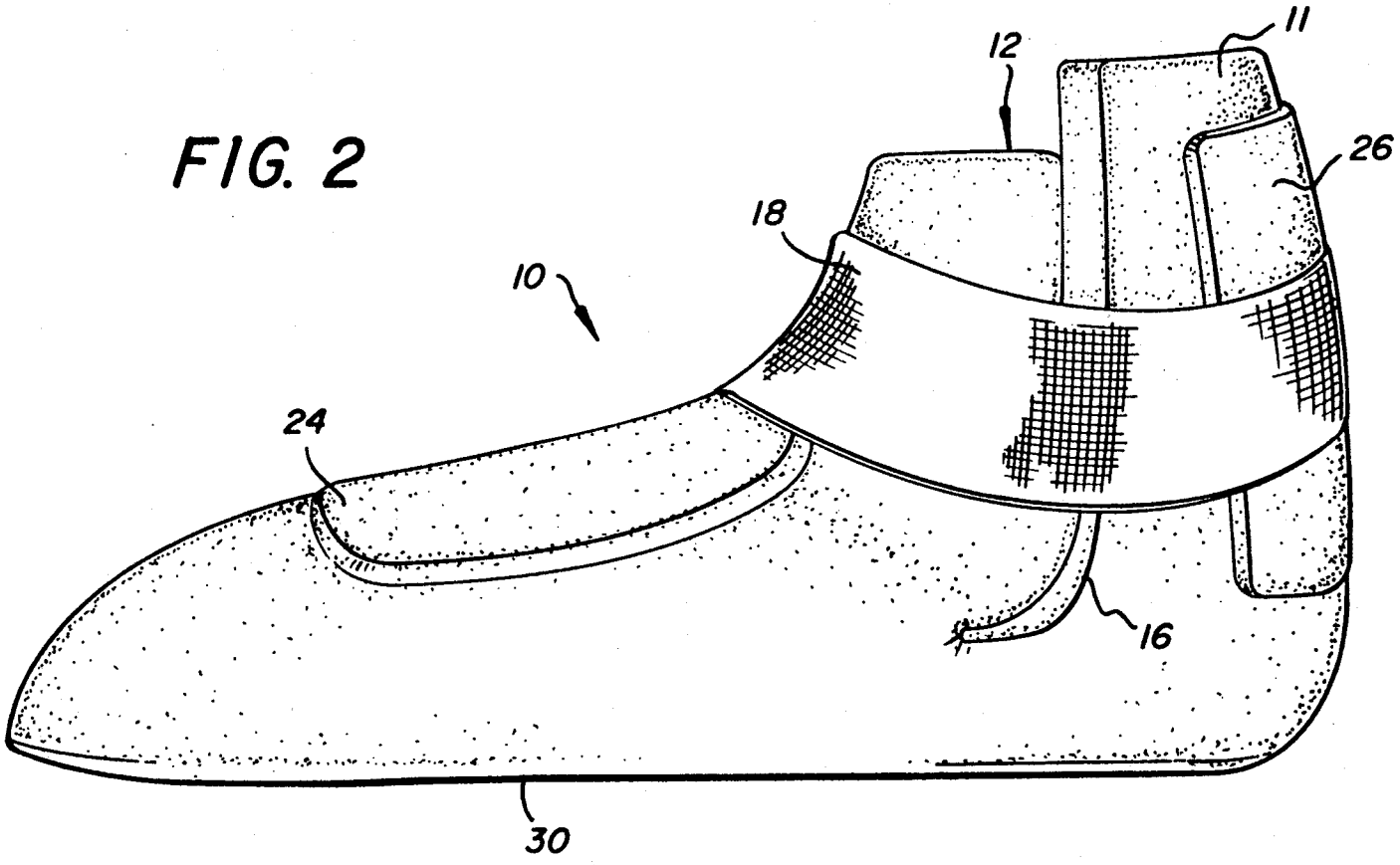
FIG. 2 is an enlarged side elevational view of the shoe of FIG. 1.
Figure 3:
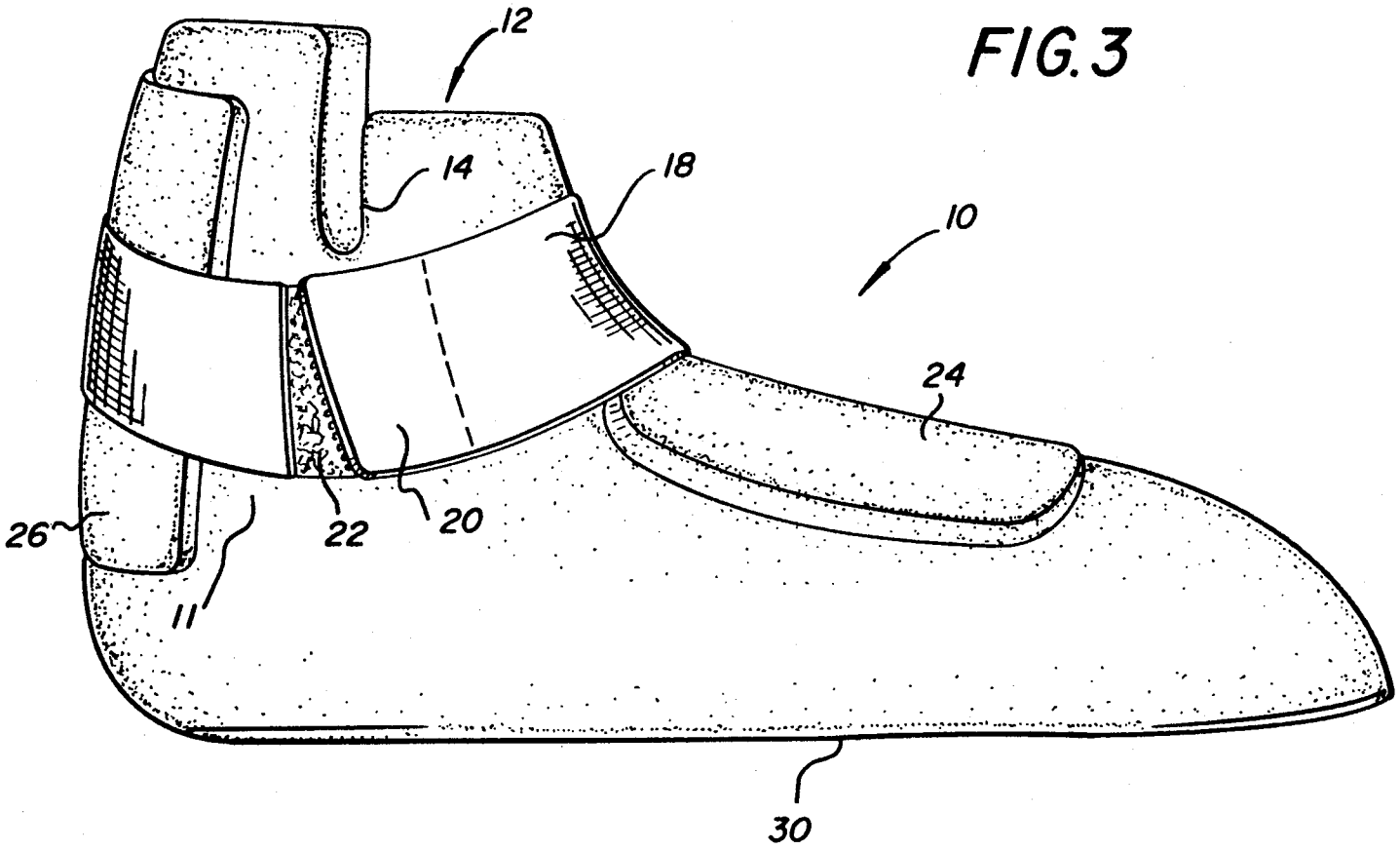
FIG. 3 is an opposite side elevational view of the shoe shown in FIG. 2.
Figure 5:
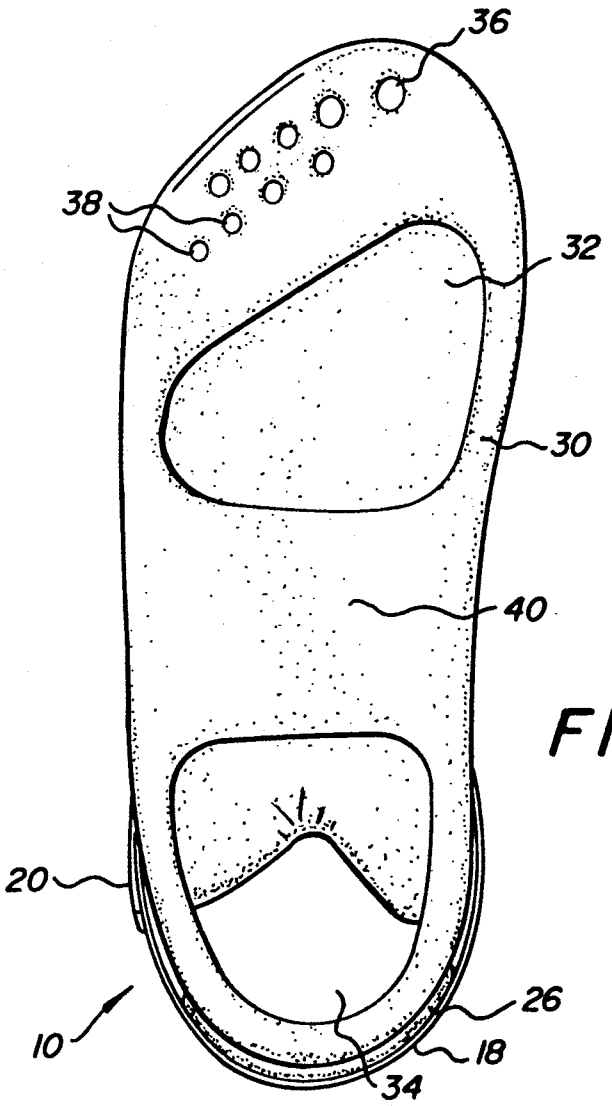
FIG. 5 is a bottom plan view of the inventive shoe.
Figure 4:
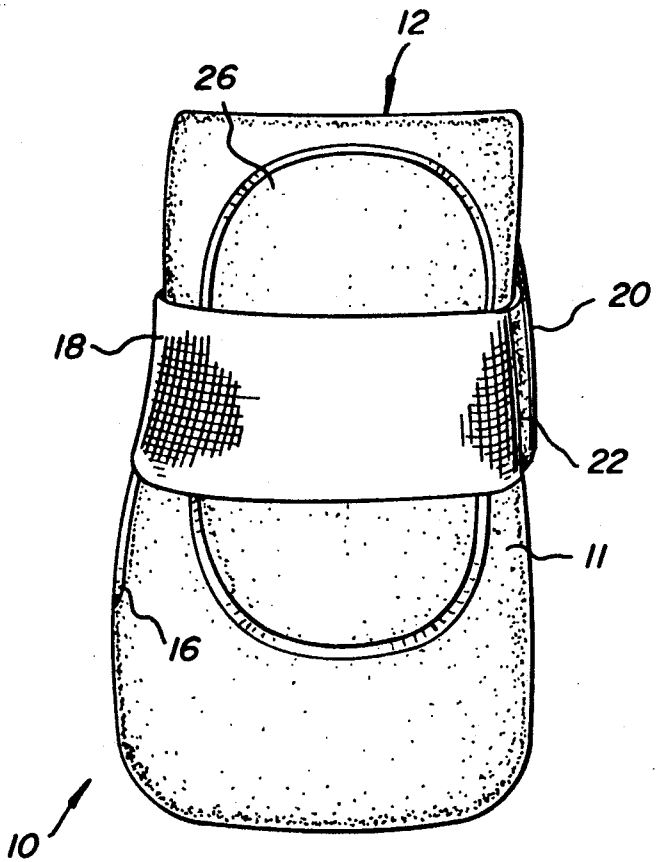
FIG. 4 is a rear elevational view of the inventive shoe.

The preferred embodiment and best mode of the protective shoe is shown in FIGS. 1–5. The fully enclosed shoe 10 is shown having an upper opening 12 with downwardly projecting slits 14 and 16. These slits provide for ease in spreading the upper opening and the top of the upper to provide an anatomically correct entrance for the foot artery (posterior tibial artery) to maximize circulation upon insertion of the wearer's foot and eliminate a stress point upon the circulation of the foot when placing the shoe on the foot. Slit 14 is linear and roughly V-shaped and is located on the outside, side portion of the shoe extending downward toward the sole about one inch. Slit 16 is arcuate and roughly J-shaped and is located on the medial aspect or inside of the ankle. Slit 14 is on the lateral aspect or the outside of the ankle, thus allowing the shoe to be easily placed on the foot as previously mentioned. An elastic strap 18 with VELCRO fastener end sections 20 and 22 formed on opposite sides of the strap is secured on the ankle portion of the outside side of the shoe upper 11 below the smaller slit 14. The strap 18 is an elastic weave two inches thick adhesively glued on one end to the upper 11, with VELCRO fasteners on each end, so that the elastic expands to permit pulling the strap around the shoe so that the VELCRO-fastener end sections 20 and 22 mate holding the shoe firmly in place on the wearer's ankle as is shown in FIG. 3.

The shoe upper 11 is constructed of a base foam half an inch thick of INSOLITE PVC. A shell foam of ethylvinylacetate one quarter inch in thickness having a #1.5 pound low density is placed on the base foam on the top of the upper in the instep area to form a protective pad 24 and on the back of the upper on the rear of the ankle approximate the location of the achilles tendon to form a second protective pad 26. These pads 24 and 26 which preferably range in size from 2"×4" to 3"×5" provide additional strength and protection to the foot to protect it from the additional stresses and contact occurring during the kicking exercises and in actual contact in karate, tae kwan do, kung fu, kick boxing, etc.

A bottom or sole member 30 is constructed of nylon reinforced vinyl and is glued to the upper 11 with a solvent-based neopreme glue. The sole member 30 is cut out to form a heel opening 34 and a ball of foot opening 32 so that the heel and the ball of the foot of the user will have contact with the playing surface. This sole member is the piece which countours the shoe to a right and left foot allowing for the shoe to conform to each separate foot. The sole member forms a toe area 36 provided with a plurality of holes 38 so that there can be continuous ventilation in the toe area 36 to preclude or reduce perspiration in the toe area. The toes are protected by the toe area of the sole so that they cannot be caught, twisted or subjected to forces outside of the shoe area. An arch piece 40 is also formed by the sole member to keep the shoe firmly on the wearer's foot. The entire shoe, with the exception of the strap, is dipped in a polyvinylchloride coating so that a smooth colored hardened surface is provided on the entire shoe surface both upper and sole.

While various embodiments of the present invention have been shown and described herein for purposes of illustration, it will be apparent that other variations and embodiments are considered to fall within the scope of the defined invention.

What is claimed is:

1. A protective shoe for use in contact sports comprising a unitary casing member defining an opening into which a foot can be inserted, a strap attached to the unitary casing member allowing the casing member to be held around the ankle of the wearer, said casing member comprising an upper member and a lower sole member secured to said upper member, the upper member being provided with an opposed plurality of slits extending downward toward the sole member, one of said slits being curved at one end and positioned behind the location which the ankle bone of the wearer's leg would occupy in the shoe, said sole member in combination with said upper member defining an enclosed toe area with a plurality of throughgoing apertures formed in said sole member to provide ventilation of said toe area, said sole member defining a mid foot strap as well as defining selectively the specific foot configuration and a protective instep pad and achilles tendon pad secured to said upper member external of said upper member to respectively give additional foot protection to the user by dissipating force directed to said instep, said achilles pad and the unitary casing member.

2. A protective shoe for use in contact sports of the martial arts variety comprising a unitary upper member constructed of a foam base defining an opening into which a foot can be inserted and side slits provided through said upper member defining a front section and a rear section which is higher than said front section, said side slits comprising a first slit in an outer side of said upper member and a second longer slit extending at least to the ankle joint of the wearer in an opposite arch side of said upper member, an elastic strap secured to the upper member holding said front section and rear section in a preset relationship, said elastic strap being provided with a fastener allowing both sections of said upper member to be attached around the ankle of the wearer, a sole specifically configured to fit the specific foot of a person mounted to said upper member, said sole comprising an enclosed toe area, a mid strap located over the arch area and defining an open heel area and open ball of foot area, an instep protective pad and achilles tendon protective pad secured externally to said upper member to provide force dissipation from blows delivered to the padding.

3. A protective shoe as claimed in claim 2 wherein said fastener means are VELCRO fasteners which are attached to opposite sides of the elastic strap.

4. A protective shoe as claimed in claim 2 wherein said second longer slit has a J shape.

5. A protective shoe as claimed in claim 2 wherein said upper member is coated with polyvinylchloride.

6. A protective shoe as claimed in claim 2 wherein said sole means is a nylon reinforced vinyl material.

7. A protective shoe as claimed in claim 2 wherein said foam base is approximately ½ inch thick.

8. A protective shoe as claimed in claim 2 wherein said instep protective pad and said achilles protective pad are approximately ¼ inch thick.

9. A protective shoe as claimed in claim 2 wherein said instep protective pad means and said achilles protective pad means are covered with a ethylvinylacetate coating.

10. A protective shoe for use in contact sports of the martial arts comprising a unitary upper member constructed of a foam base defining an opening and opposite side slits having different lengths into which a foot can be inserted to provide a substantially unrestricted entrance for the foot artery of the wearer's foot to maximize circulation, said opposite side slits comprising a first slit on the lateral side of the upper member running downwards, another slit being formed in the medial side of the upper member running downward past the end of the first slit on the opposite side and extending at least to the ankle joint of the wearer following the region of the wearer's artery, an elastic strap provided with a hook and fastener assembly is secured to the upper member below the first slit allowing the upper member to be firmly attached around the ankle of the wearer, a sole member constructed of reinforced material is secured to the bottom of the upper member to provide a shoe constructed specifically for one of the left or right feet to a person, said sole member providing an enclosed toe area and a mid strap over the foot arch area with cutouts in the sole member defining an open heel area and open ball of foot area allowing the heel and ball of the foot of the user to be exposed when the shoe is worn, a protective instep pad and achilles tendon pad are secured to and extend outward from said upper member in the instep area and achilles tendon area, respectively, to give additional foot protection to the wearer so that blows delivered to these areas will be dissipated through the upper member.

* * * * *